US007971639B2

(12) United States Patent
Revheim

(10) Patent No.: US 7,971,639 B2
(45) Date of Patent: Jul. 5, 2011

(54) DEVICE FOR CONDUCTING CEMENTING OPERATIONS AND INFLOW REGULATION

(75) Inventor: Sven Revheim, Hafrsfjord (NO)

(73) Assignee: Peak Well Solutions AS, Tananger (NO)

( * ) Notice: Subject to any disclaimer, the term of this patent is extended or adjusted under 35 U.S.C. 154(b) by 187 days.

(21) Appl. No.: 11/989,892

(22) PCT Filed: Aug. 17, 2006

(86) PCT No.: PCT/NO2006/000298

§ 371 (c)(1),
(2), (4) Date: Apr. 30, 2009

(87) PCT Pub. No.: WO2007/021198

PCT Pub. Date: Feb. 22, 2007

(65) Prior Publication Data

US 2009/0211748 A1 Aug. 27, 2009

(30) Foreign Application Priority Data

Aug. 18, 2005 (NO) ..... 20053880

(51) Int. Cl.
*E21B 33/14* (2006.01)

(52) U.S. Cl. ..... 166/177.4; 166/332.4

(58) Field of Classification Search ..... 166/289, 166/177.4, 205, 332.4, 334.4
See application file for complete search history.

(56) References Cited

U.S. PATENT DOCUMENTS

| | | | | |
|---|---|---|---|---|
| 3,768,562 | A | 10/1973 | Baker | |
| 4,429,747 | A * | 2/1984 | Williamson, Jr. | 166/321 |
| 4,928,772 | A | 5/1990 | Hopmann | |
| 7,367,393 | B2 * | 5/2008 | Vachon | 166/250.01 |
| 7,748,463 | B2 * | 7/2010 | Revheim | 166/332.4 |

* cited by examiner

*Primary Examiner* — William P Neuder
(74) *Attorney, Agent, or Firm* — Ladas & Parry

(57) ABSTRACT

The present invention relates to a cementing or inflow regulation valve for conducting cementing operations or inflow regulation in a wellbore comprising a casing or tubing (2), wherein the cementing or inflow regulation valve (1) is inserted between the casing or tubing (2), wherein the cementing or inflow regulation valve (1) comprises an inner sliding sleeve valve (3) which in a closed position covers a number of openings (4) through an outer pipe (5) of the casing or tubing (2) and which in an open position uncovers said openings (4), the sliding sleeve valve (3) comprising a releasing means (6) requiring a certain force to be released both from the closed position to the open position, and vice versa. The invention is characterized in that between the sliding sleeve valve (3) and the outer pipe (5) of the cementing or inflow regulation valve (1), when the sliding sleeve (3) is in a closed position, a sealed chamber (12) is formed being filled with a fluid preventing ingress of undesired drilling and formation fluids and solids, sealing elements (10) being provided in the openings (4) of the outer pipe of the cementing or inflow regulation valve (1), preventing ingress of any solids, fluids and cement located inside or outside the casing or tubing (2).

10 Claims, 14 Drawing Sheets

DEVICE FOR CONDUCTING CEMENTING OPERATIONS AND INFLOW REGULATION

Figure 2:
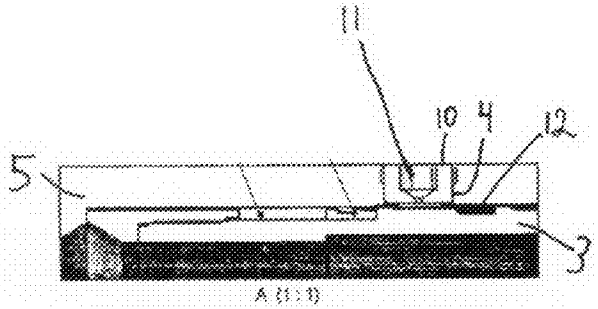

The present invention relates to a device for conducting cementing operations or inflow regulation in a wellbore according to the ingress of the accompanying independent claim 1.

In the construction of wells, it is a requirement from The Norwegian Oil Directorate that a casing installed inside another casing must be pressure-tight before drilling is performed through the bottom of the last installed casing. During conventional cementing operations, cement is usually injected through a check valve installed at the bottom of the casing. In order to comply with the pressure requirements, an amount of cement sufficient to form a column of at least 50 m height on the outside of and within the casing is injected. The cement is then tested from within the casing against brush plugs, with the check valve at the bottom of the casing being closed. In order to save time, the casing is tested when the cement is still wet, and if leaks are discovered, an additional amount of cement is forced into the leak passage, after which a new pressure test is carried out. Such cement refilling operations are technically challenging and costly, and do not always give a satisfactory result.

In some wells, it is desirable to seat the casing bottom in bedrock having less pressure than shallower rock. The cement exiting through the bottom of the casing will select the path of least resistance, in this case downwardly into the weak zone due to gravity. As a result, the minimum requirement of a cement column extending at least 50 m above bottom level will not be achieved.

In order to obtain a pressure-tight casing, it is common to install a circular valve that is threaded onto the casing 50 m above the bottom level of the casing. Often, a pressure-operated valve is used, in which case a plug is pumped towards the valve in front of the cement in order to open the valve and then another plug is pumped behind the cement to close the valve. Due to gravity, or by means of an applied pressure, the cement column rises to the required 50 m, so that a pressure test may be performed to verify that the casing is in fact pressure-tight. The drawback of this method is that the valve needs to have a wall thickness that makes the outer diameter exceed the outer diameter of the casing. Moreover, the rotational moment that such a valve is able to support is significantly lower than the moment required for a casing, so that this method is not appropriate for applications in which it is necessary to rotate the casing in order to "drill" the pipe down to the desired depth. Also, the inner diameter of such a valve will generally be less than the inner diameter of the casing, which is a major drawback. The seals of these valves have shown to be unreliable, and their pressure rating is less than that for the casing, causing an undesirable weak point in the casing.

Conventional cementing valves also have the drawback that the valve mechanism is not isolated from the well liquids. This causes well liquids and possibly cement to penetrate into the movable parts of the valve mechanism, increase the friction, block cementing ports, and/or concrete stuck packers, making the valves unreliable. The conventional technology is further characterized by that no verification is obtained at the rig floor of whether or not the cementing valve is functioning properly. The valves are operated by pumping down rubber plugs in front of and behind the cement. The first rubber plug opens the valve by pressing on a sleeve valve. The second rubber plug closes the valve by pumping a sliding sleeve. Due to the complexity of the system and the fact that the work is performed at a depth of several thousand meters using high pumping rates, it is almost impossible to detect a pressure buildup verifying the opening and closing of a cementing valve. In addition, a viscous, compressible oil-based drilling mud is used creating a delay of several minutes before a pressure buildup can be seen at the rig floor. For example, this may lead to the incorrect assumption that an appropriate amount of cement has been pumped into the annulus when this is actually not the case. Subsequently, this may result in an uncontrolled blowout, which is extremely severe and costly.

During cementing operations, "mechanically operated" cementing valves are frequently used. Such valves may be installed anywhere in a casing and in any number needed in order to seal a well. The valve may be constructed so that its inner diameter equals the inner diameter of the casing and its outer diameter equals the outer diameter of the casing connectors. The conventional cementing valves used today does not exhibit the same pressure rating as casings do due to a thin wall thickness and deficient sealing technology. The conventional solutions use an opening and closing tool which is used for placing a pre-selected amount of liquid cement or another type of liquid out through the ports of the cementing valve in order to obtain the desired pressure seal around casings. In the prior art, the valve is opened and closed by means of a sleeve seal and valve ports by moving the drill string up and down. When the cementing operation is completed, the valve is closed and a pressure test of the valve and casings may be conducted. The drill string is released from the cementing valve by rotating the drill string until a tool mounted thereon is no longer locked in grooves on the cementing valve. It is also known to use a non-rotational up and down movement in connection with a friction lock in order to open and close the cementing valve, whereby a tool is released from an engagement with a profile of the cementing valve when a given force is applied.

The conventional solutions used today have the following drawbacks: The rotational moment is less than that of casing connectors and may not be verified by calculation. This constitutes a risk in applications in which "drilling" is performed using the pipe on which the valve is mounted. The worst conceivable scenario is that a valve is split in two halves, so that the casing is severed. The pressure rating of the conventional cementing valves is substantially less than the pressure rating of a casing. None of the conventional solutions in use today exhibits a pre-verifiable adjusted indication on the repeatable opening and closing or any indication at all of the position in which the individual valve is located or of which valve is currently operated. This makes the operation critical, especially for greatly deviating wells in which due to vertical and torsional friction, it is difficult to verify the rotation or axial up and down movements at the surface. The lack of verification makes operations critical as it is a risk of pumping cement to an undesired location, with the worst conceivable scenario being that a drill string is concrete stuck.

Other critical situations that may arise with the conventional solutions are that the valve may be opened in an uncontrolled manner in that equipment are run past the valve. The valves are kept closed by frictional forces, that is, only frictional forces from packers and O-rings, which in many cases is not sufficient to prevent the valve from being unintentionally opened. Moreover, the conventional solutions provide no protection preventing undesired fluids and solids from entering into the critical parts of the valves, which could easily cause failure of the valve function.

Well cementing operations are usually carried out several times as several casings are installed inside each other within a well, and each time when a casing is completed, cementing must be conducted. It is therefore important to have equipment allowing the opening and closing operations for the cement mixture to be carried out repeatedly. It is also important that the outer walls of the pipes are level, and it is an absolute precondition that the pipe walls and the cementing valve do not form weak points in the well.

In strongly deviating (non-vertical) wells, gravity will cause the injected cement to set in the lower half of the annulus, and usually no reliable seal is obtained between the pipes in the upper part of the annulus.

Often, it may be a problem that the valve is not tight or has become stuck due to ingress of solids between the sliding sleeve and the surrounding pipe. Even though the sliding sleeve is provided with seals, it is often found that solids have entered the area between the sliding sleeve and the surrounding pipe. I such cases, the seals may be broken and/or solids may cause various locking mechanisms located between the sliding sleeve and the surrounding pipe to fail or not function appropriately.

U.S. Pat. No. 3,768,562 relates to a cementing valve for conducting cementing operations in a well, wherein the cementing valve includes a sleeve valve which in a closed position covers a number of openings and in an open position uncovers the openings. The sleeve valve includes a release means requiring a certain force in order to open or close. The release means is actuated by a gripping tool requiring a certain force in order to open or close.

U.S. Pat. No. 5,299,640 relates to a cementing device comprising cementing ports that may be opened and closed by a sliding valve. The valve may be opened and closed by means of a driving device that is actuated by means of appropriate received signals.

There are also other cases in which a repeatable opening and closure of a sliding sleeve installed in a wellbore are of the utmost importance. Such a sliding sleeve may also be installed in, for example, a tubing and used for controlling the flow of produced fluids into the tubing. The device according to the present invention may also find use in connection with such an inflow restriction device.

NO 923625 relates to an inflow restriction device for controlling the production from wells, in particular horizontal wells. The inflow restriction devices are arranged in such a manner that their inlets are connected to an annulus between a filter and the discharge pipe and that their outlets are connected to the flow bore of the discharge pipe. Such an inflow restriction device is also commonly referred to as a choke, and used for regulating the flow of fluids into the flow bore of the discharge pipe, in particular in horizontal wells. By regulating the inflow, the production may be optimized and so-called coning be postponed.

The present invention provides an improved device for conducting cementing operations for a casing or inflow regulation for a tubing.

According to the present invention, some of the above problems are overcome by a device characterized by the features set forth in the characterizing part of the independent claim, with other advantageous and preferred embodiments being set forth in the dependent claims.

Figure 3:
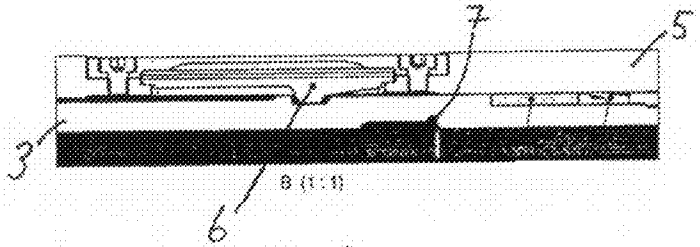
Figure 1:
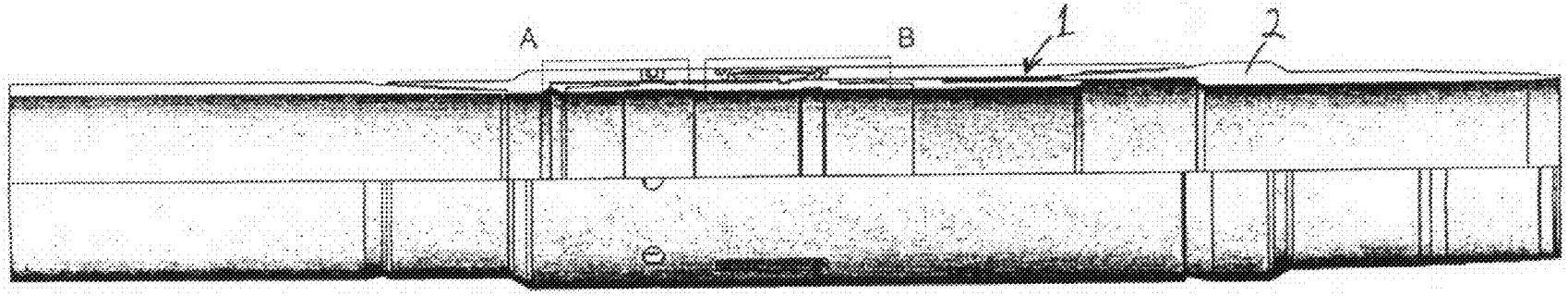
Figure 4B:
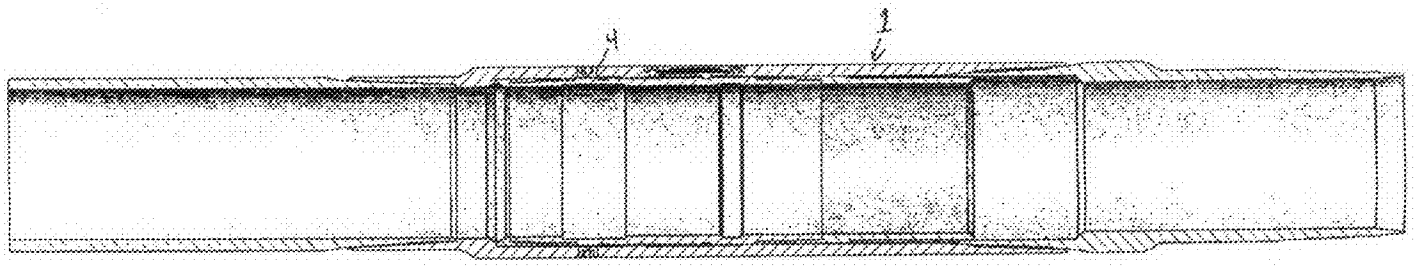
Figure 4A:
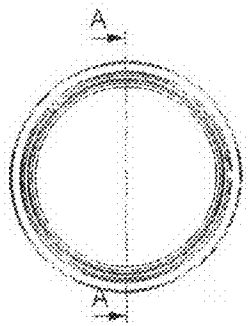
Figure 7:
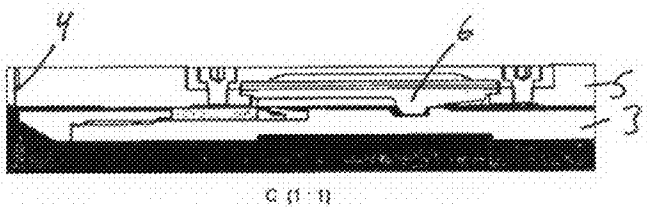
Figure 6:
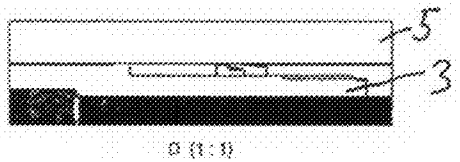
Figure 5:
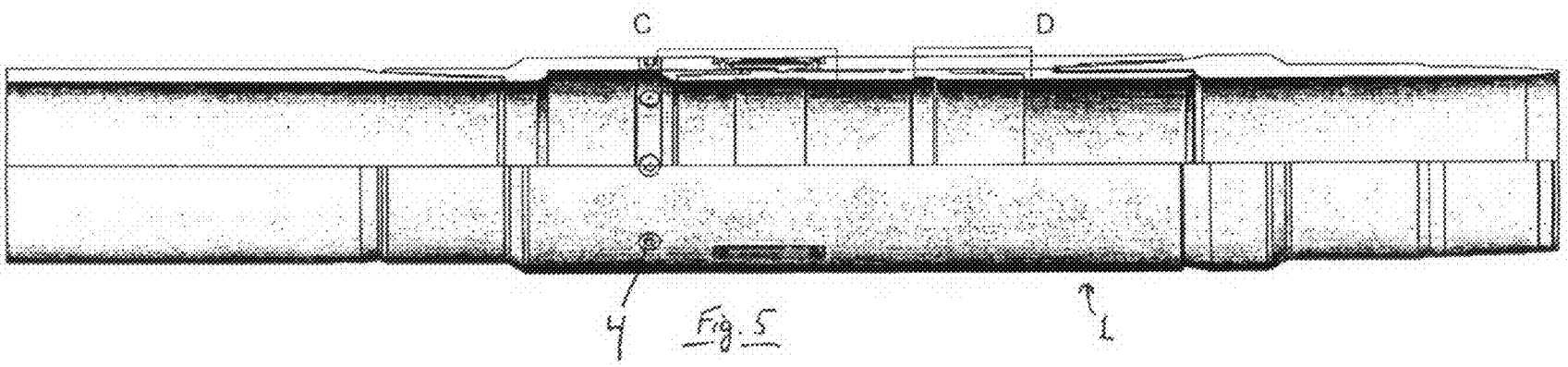
Figure 8:
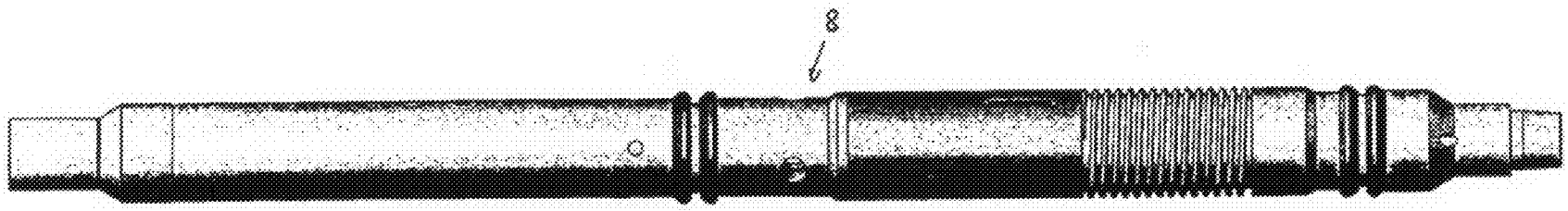
Figure 8B:
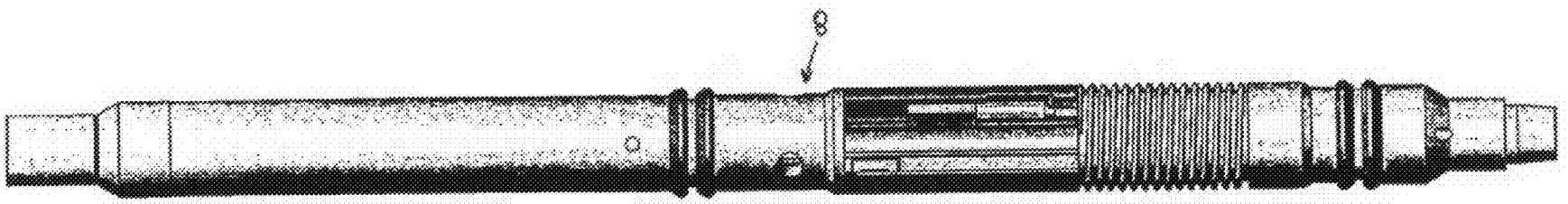
Figure 9A:
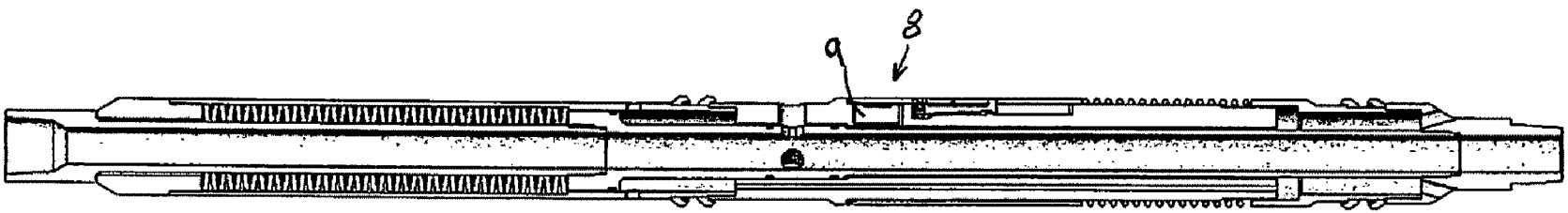
Figure 9B:
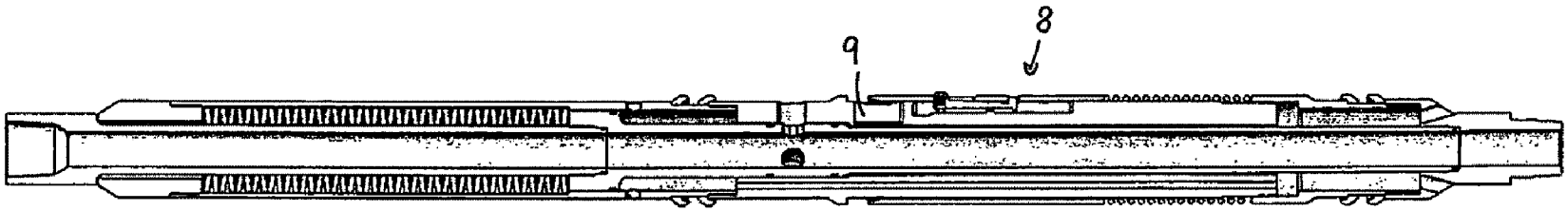
Figure 9C:
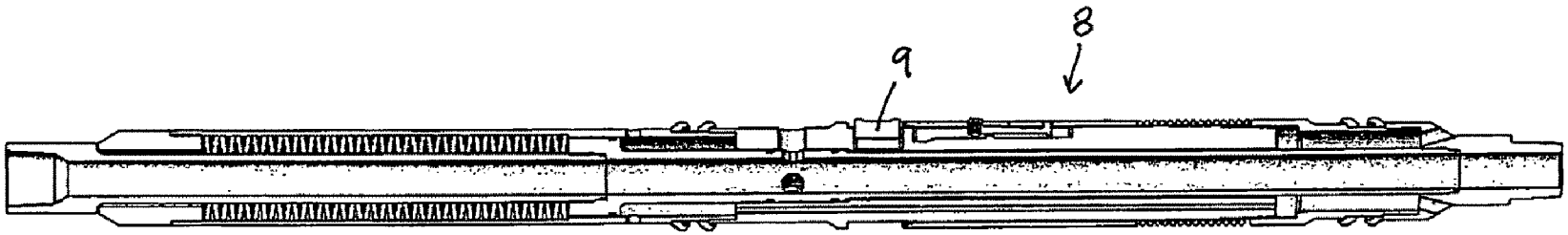
Figure 9D:
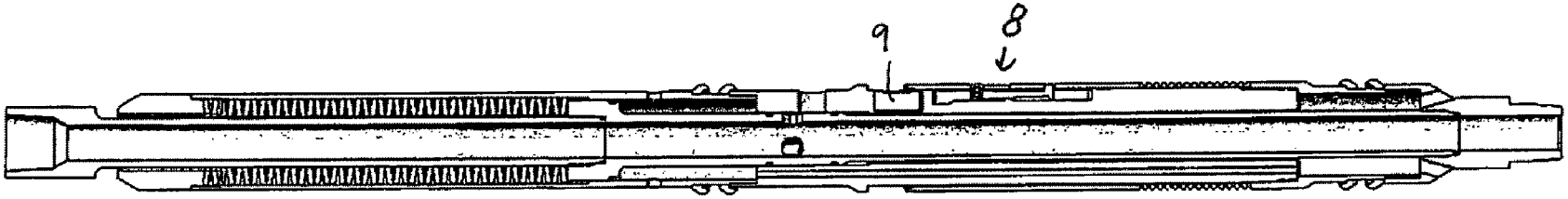
Figure 10A:
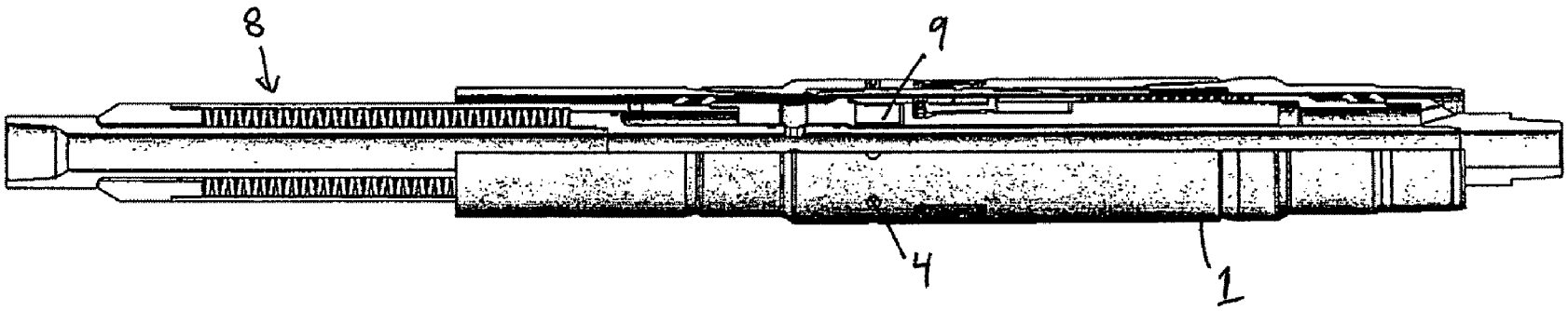
Figure 10B:
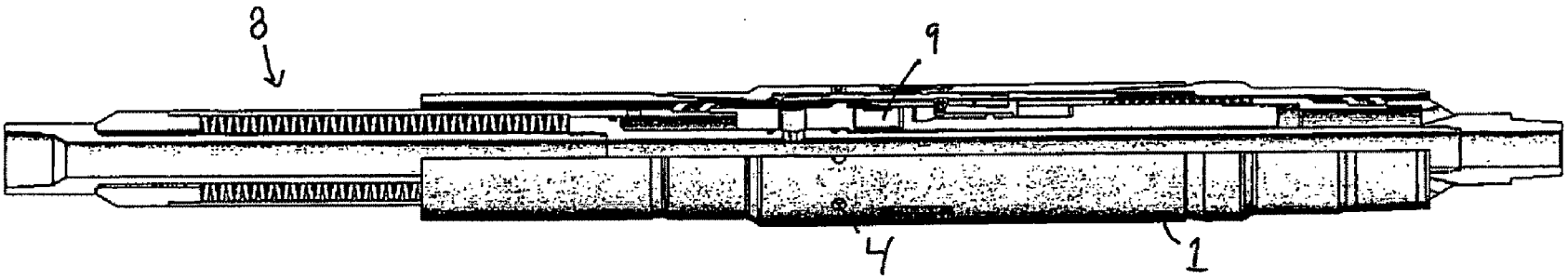
Figure 10C:
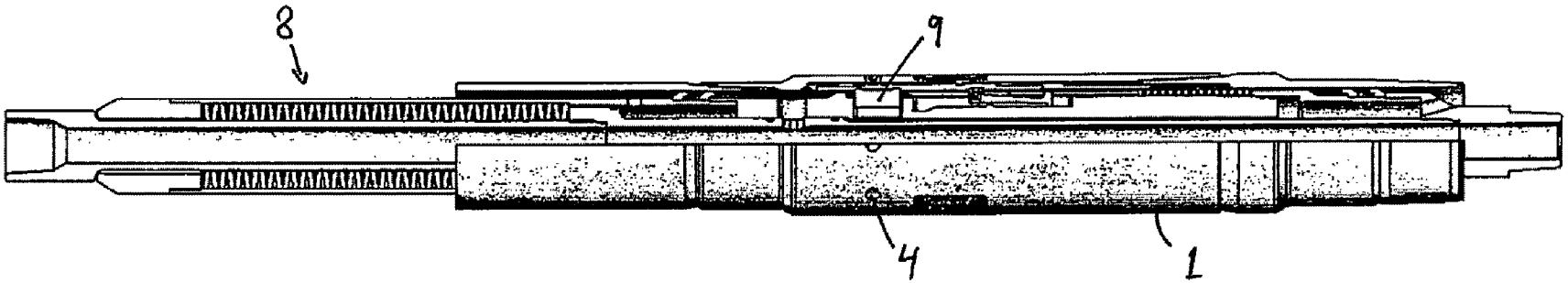
Figure 10D:
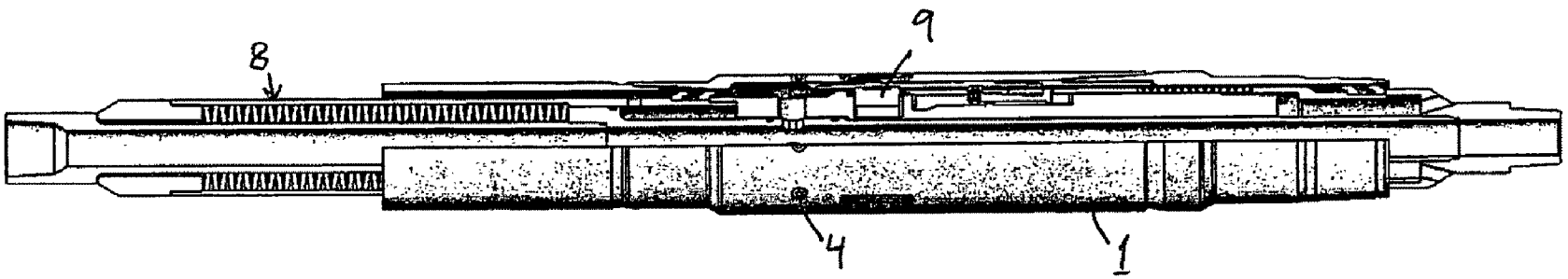
Figure 10E:
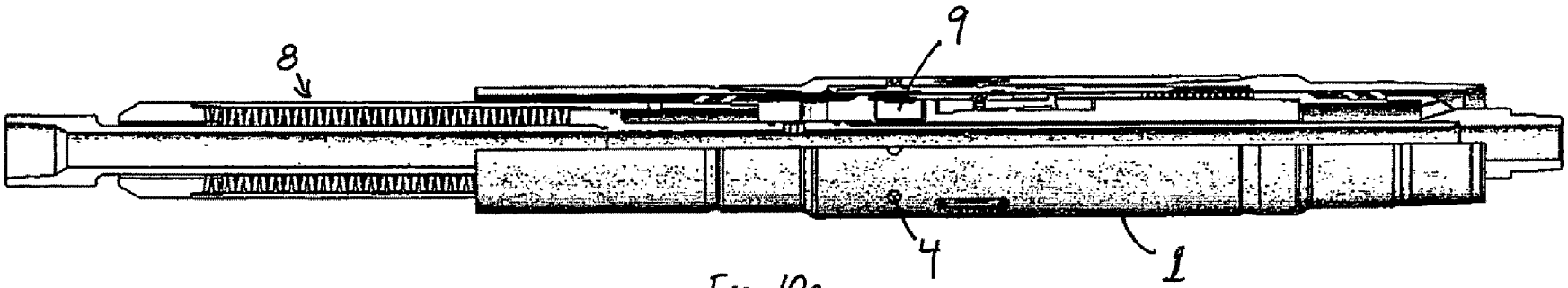

FIG. 1 shows an embodiment of a valve according to the present invention, wherein the valve is in a closed position, FIG. 2 shows a section A of FIG. 1, FIG. 3 shows a section B of FIG. 1, FIGS. 4*a* and 4*b* show a perspective view and a longitudinal section of the embodiment shown in FIG. 1, respectively, FIG. 5 shows an embodiment of a valve according to the present invention, wherein the valve is in an open position, FIG. 6 shows a section C of FIG. 5, FIG. 7 shows a section D of FIG. 5, FIGS. 8*a-b* and 9*a-d* show an exemplary well running tool that may be used in connection with the present invention, and FIGS. 10*a-e* shows how the well running tool may be used in a valve according to the present invention.

Figure 4A:
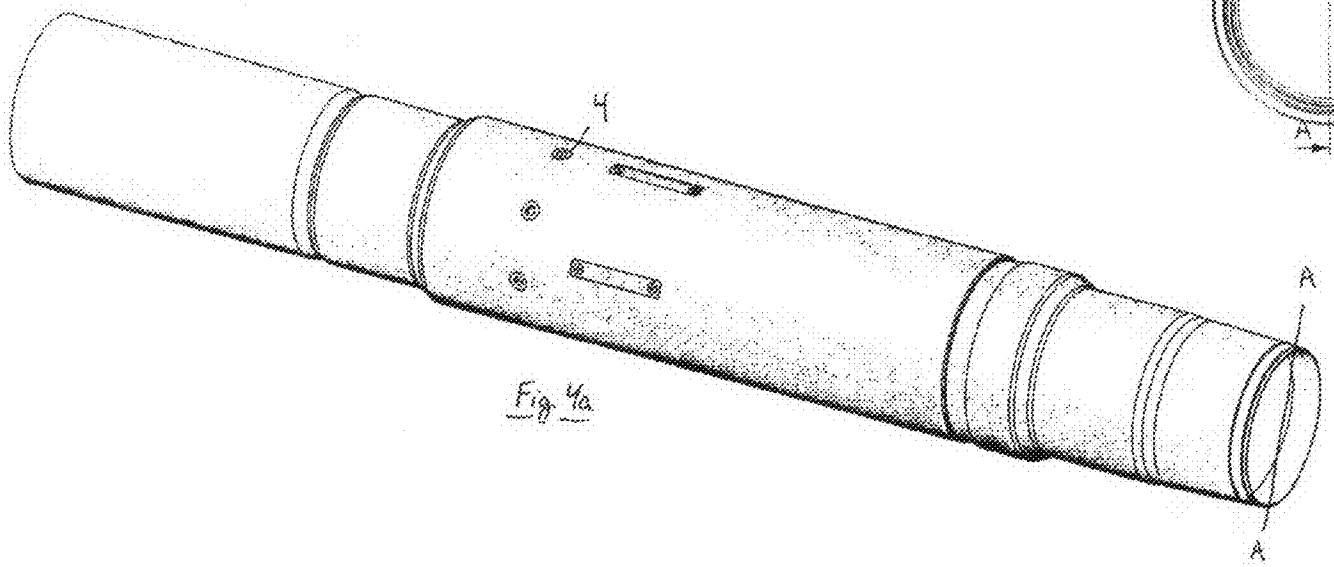

FIGS. 1 and 4 show an embodiment of a valve 1 according to the present invention. According to this embodiment, one or more valves 1 are installed between casing sections or tubing sections 2 to form a valve section. Each cementing valve section has an inner and outer diameter being substantially equal to the inner and outer diameter of the casing or tubing, respectively, with the mechanical properties of the cementing valve section or tubing valve with respect to tensile strength, compressive strength, pressure sealing properties, etc. being equivalent to or exceeding the mechanical properties of the casing or tubing 2. The valve 1 includes an inner sliding sleeve valve 3 that in its closed position covers a number of holes 4 through an outer pipe 5 of the valve section and that in its open position uncovers said holes 4. The sliding sleeve valve 3 includes release means 6 requiring a certain force to be released both from the closed position to the open position, and vice versa. Such release means 6 may include a spring arrangement, lug, or another mechanism preventing the sliding sleeve valve 3 from opening or closing in an undesired manner, as the release means 6 requires a predetermined force, such as 10 or 20 tons of force, for example, to release. Within the sliding sleeve valve 3, latching elements 7 are provided, such as grooves, recesses, beads, lugs, cams, or the like, that a well running tool 8 comprising corresponding gripping tools 9 may engage.

According to a preferred embodiment, sealing elements 10, in the form of plugs, for example, are provided in the holes 4 in the outer pipe 5 of the valve section, wherein such sealing elements 10 help preventing the ingress of undesirable materials into the valve mechanism, such as solids, fluids, and/or cement located in the annulus outside the casing or tubing 1, 2.

The sealing elements 10 may further include pressure balancing means 11 that make sure the pressure difference across the plug from becoming too large. When the sliding sleeve 3 is in a closed position, according to a preferred embodiment, a sealed, fluid-filled, and possibly pressurized chamber 12 will be created, preventing the ingress of undesired drilling and formation fluids and solids. This chamber 12 is formed between the sliding sleeve valve 3 and the outer pipe 5 of the valve section. The pressure balancing means 11 of the plugs 10 will help ensuring that the pressure difference between the pressurized fluid in chamber 12 and the pressure of the surroundings does not become too large, which could cause the plug to blow out and thus expose the sliding sleeve and seals for undesirable and harmful solids. The fluid may, for example, comprise a liquid, gas or gel. The sliding sleeve 3, in cooperation with the sealing elements 10 and the possibly pressurized fluid in the sealed chamber 12, will protect all the movable parts of the valve when it is not in use, hence ensuring that the valve functions repeatedly and/or after a long period of inactivity. Any overpressure in the sealed chamber acts to prevent solids from entering through the sealing rings defining the sealing chamber.

The fluid in the sealed chamber may also comprise a self-hardening material, which self-hardening material may be caused to harden, for example, after the sliding sleeve valve 3 has been brought to a permanent locked position to thereby form a permanent seal and/or locking of the sliding sleeve valve 3. The hardening of the fluid may be initiated by injecting or releasing a hardening catalyst in the sealed chamber in which the fluid is located.

The sealed chamber may be designed to be vibration resistant. The fluid may contribute to this vibration resistance in that, for example, a fluid having an appropriate viscosity is chosen. This fluid may help protecting the valve and the mechanisms and structures located inside the sealed chamber during extreme vibrations caused by drilling or extreme flow conditions, for example.

The sealing elements 10 may be formed by plugs, embedded gates, rotating sleeves, or the like. So that, for example, a plug shall not be blown out of or in through the valve opening 4, it may be provided with a membrane or another pressure balancing means ensuring that the pressure difference across the sealing element 10 is not becoming too large.

According to a preferred embodiment of the present invention each valve section is provided with means enabling the well running tool 8 to detect and/or recognize the particular valve section. In the case of extended casing or tubing 2 penetrating through several formation layers, it could be desirable to install a number of valve sections in the casing or tubing 2 in some spaced relation. It is then important that the well running tool 8 is able to detect and/or recognize a particular valve section. The detector and/or recognition means may include magnetic, electronic, and/or mechanical detector and/or recognition means.

In connection with cementing operations, initially one or more cementing valve sections 1 will be installed in the casing 2, which is then run into the wellbore. Once a given casing section has been run down the well, the cementing operation may be initiated. Having run a well running tool 8 installed on a drill string down the well to a given cementing valve section 1, the well running tool 8 is caused to engage and open a sliding sleeve valve 3 by weight-setting the well running tool 8. When a predetermined force is exceeded, the release means 6 is actuated and the sliding sleeve 3 is opened. The well running tool 8 has a fluid connection to the surface but is otherwise sealed on each side of the cementing valve section 1. The opening of the sliding sleeve valve 3 is verified in that a surface weight indicator shows that the weight on the well running tool 8 has decreased by a value corresponding to the predetermined release force. When the opening of the sliding sleeve valve 3 has been verified pressurized cement is supplied through the well running tool 8 to the now open cementing valve section. The pressurized cement will be lead through the openings and into an annulus surrounding the casing 2 if the pressure outside the openings 4 is less than the pressure of the pressurized cement. If the annulus surrounding the casing 2 is already sufficiently pressure-tight or filled, the pressurized cement will not be able to pass on and the pressure of the cement located in the well running tool 8 increases. This is monitored at the surface by means of a pressure indicator. When the annulus surrounding the current section of the casing 2 is filled, the sliding sleeve valve 3 is pulled in the opposite direction, and the weight indicator at the surface is again used in order to confirm that the sliding sleeve valve 3 is in fact closed. It is an important aspect of the invention that the cementing valve 1 will remain operational subsequent to such an initial cementing. It is also possible to install cementing valve sections 1 which are not used during the initial cementing, but are intended used in later cementing operations if necessary. If at a later point in time it is realized that the cement on the outside of the casing 2 is not pressure-tight after all, it is possible to reopen the sliding sleeve valve 3 using the well running tool 8 and inject additional cement. In this connection it is therefore important that the well running tool 8 is able to locate and recognize a given cementing valve section 1. This is made possible by means enabling the well running tool to detect and/or recognize a given cementing valve section 1.

A similar method could be used in the case of tubing, but the purpose of the operations would then usually also be to open or close the sliding sleeve valve either completely or partly in order to regulate the flow of fluids into the tubing. The rate of inflow may then be regulated by spacing a number of valve openings 4 in the longitudinal direction of the tubing 2, the openings 4 possibly having different size or shape. By gradually displacing the sliding sleeve valve 3 over a time period, the inflow cross-section of the tubing is increased. A problem arising when using sealing elements 10 in the form of plugs, for example, is at such plugs are blown into the tubing 2. It is therefore necessary to use another type of sealing elements 10 in the form of sliding gates or a revolving ring which open the valve openings 4 when the sliding sleeve valve 3 is pulled back to uncover the valve openings 4, and correspondingly close the valve openings 4 if the sliding sleeve valve 3 is again actuated to cover a number of valve openings 4. In this manner the sealed chamber is maintained even after the sealing elements 10 have been opened one or more times.

It is an important aspect of the invention that it provides an improved predictability with regard to knowing and expecting that the valve 1 is actually functioning as intended. By using the sealed chamber according to the present invention, the operator will know with greater certainty that the valve 1 is functioning properly even after an extended period of inactivity. This is by no means a matter of course with the conventional solutions in use today.

The present invention could also be of utmost importance for the so-called intelligent valves. The space formed by the sealed chamber then may be shaped to accommodate electric devices, such as driving mechanisms, sensors, etc. In such a case the fluid in the sealed chamber may also be chosen based on its electric properties, temperature properties, and/or pressure properties. The sensors may sense important parameters in the sealing fluid and/or from another point that may be of significance for the process and the intelligent valve, after which driving mechanisms in the sealed chamber may be actuated to open or close the sliding sleeve valve 3 or to carry out other tasks.

The invention claimed is:

1. A cementing or inflow regulation valve for conducting cementing operations or inflow regulation in a wellbore including a casing or tubing, wherein the cementing or inflow regulation valve is inserted between the casing or tubing; the cementing or inflow regulation valve comprising an inner sliding sleeve valve slidable between a closed position at which the inner sliding sleeve valve covers a plurality of openings defined on an outer pipe of the casing or tubing and an open position at which said openings are not covered by the inner sliding sleeve valve, the sliding sleeve valve comprising a releasing means for requiring a certain force in order to slide the inner sliding sleeve valve both from the closed position to the open position, and vice versa; wherein when the sliding sleeve is in the closed position, a sealed chamber is formed between the sliding sleeve valve and the outer pipe of the cementing or inflow regulation valve, the sealed chamber being killable with a fluid to prevent ingress of undesired drilling and formation fluids and solids; wherein sealing elements are provided in the openings of the outer pipe of the cementing or inflow regulation valve to prevent ingress of any solids, fluids and cement located inside or outside the casing or tubing; and wherein the sealing elements comprise plugs installed in the openings and pressure balancing means for preventing a pressure difference across the plugs from exceeding a limit.

2. The cementing valve of claim 1, wherein the fluid in the sealed chamber is pressurized.

3. The cementing valve of claim 1, wherein the fluid in the sealed chamber comprises a liquid, a gas or a gel.

4. The cementing valve of claim 1, wherein the sliding sleeve, in combination with the sealing elements and the fluid located in the sealed chamber, protects all movable parts in the cementing valve when it is not in use.

5. The cementing valve of claim 1, further comprising a detector and/or recognition means for enabling a well running tool to detect and/or recognize a particular cementing valve.

6. The cementing valve of claim 5, wherein the detector and/or recognition means comprises magnetic, electronic, and/or mechanical detector and/or recognition means.

7. The cementing valve of claim 1, further comprising a weight indicator at a surface for indicating whether the sliding sleeve valve is in the open or closed position.

8. The cementing valve of claim 1, further comprising a pressure indicator on a surface for indicating a pressure of cement fed through a well running tool and into the cementing valve.

9. A cementing or inflow regulation valve for conducting cementing operations or inflow regulation in a wellbore including a casing or tubing, wherein the cementing or inflow regulation valve is inserted between the casing or tubing; the cementing or inflow regulation valve comprising:

an inner sliding sleeve valve slidable between a closed position at which the inner sliding sleeve valve covers a plurality of openings defined on an outer pipe of the casing or tubing and an open position at which said openings are not covered by the inner sliding sleeve valve, the sliding sleeve valve comprising a releasing means for requiring a certain force in order to slide the inner sliding sleeve valve both from the closed position to the open position, and vice versa;

a weight indicator at a surface for indicating whether the sliding sleeve valve is in the open or closed position;

wherein when the sliding sleeve is in the closed position, a sealed chamber is formed between the sliding sleeve valve and the outer pipe of the cementing or inflow regulation valve, the sealed chamber being fillable with a fluid to prevent ingress of undesired drilling and formation fluids and solids; wherein sealing elements are provided in the openings of the outer pipe of the cementing or inflow regulation valve to prevent ingress of any solids, fluids and cement located inside or outside the casing or tubing.

10. A cementing or inflow regulation valve for conducting cementing operations or inflow regulation in a wellbore including a casing or tubing, wherein the cementing or inflow regulation valve is inserted between the casing or tubing; the cementing or inflow regulation valve comprising:

an inner sliding sleeve valve slidable between a closed position at which the inner sliding sleeve valve covers a plurality of openings defined on an outer pipe of the casing or tubing and an open position at which said openings are not covered by the inner sliding sleeve valve, the sliding sleeve valve comprising a releasing means for requiring a certain force in order to slide the inner sliding sleeve valve both from the closed position to the open position, and vice versa;

a pressure indicator at a surface for indicating a pressure of cement fed through a well running tool and into the cementing valve;

wherein when the sliding sleeve is in the closed position, a sealed chamber is formed between the sliding sleeve valve and the outer pipe of the cementing or inflow regulation valve, the sealed chamber being fillable with a fluid to prevent ingress of undesired drilling and formation fluids and solids; wherein sealing elements are provided in the openings of the outer pipe of the cementing or inflow regulation valve to prevent ingress of any solids, fluids and cement located inside or outside the casing or tubing.

* * * * *